US009169605B2

(12) United States Patent
Corcoran et al.

(10) Patent No.: US 9,169,605 B2
(45) Date of Patent: Oct. 27, 2015

(54) SYSTEM AND METHOD FOR DETERMINING A STATE OF COMPACTION

(71) Applicant: Caterpillar Inc., Peoria, IL (US)

(72) Inventors: Paul T. Corcoran, Washington, IL (US); Allen J. DeClerk, Princeton, IL (US)

(73) Assignee: Caterpillar Inc., Peoria, IL (US)

( * ) Notice: Subject to any disclaimer, the term of this patent is extended or adjusted under 35 U.S.C. 154(b) by 56 days.

(21) Appl. No.: 13/901,092

(22) Filed: May 23, 2013

(65) Prior Publication Data

US 2014/0348587 A1 Nov. 27, 2014

(51) Int. Cl.

| | |
|---|---|
| ***E01C 19/23*** | (2006.01) |
| ***E01C 19/26*** | (2006.01) |
| ***E01C 19/28*** | (2006.01) |
| ***E01C 23/01*** | (2006.01) |

(52) U.S. Cl.

CPC ..... *E01C 23/01* (2013.01); *E01C 19/23* (2013.01); *E01C 19/26* (2013.01); *E01C 19/288* (2013.01)

(58) Field of Classification Search

CPC ..... E02D 3/026; E02D 3/02; E02D 3/0265
USPC ..... 404/122, 124
See application file for complete search history.

(56) References Cited

U.S. PATENT DOCUMENTS

| | | | | |
|---|---|---|---|---|
| 5,415,494 | A | 5/1995 | Steffen | |
| 6,188,942 | B1 | 2/2001 | Corcoran et al. | |
| 6,431,790 | B1 | 8/2002 | Anderegg et al. | |
| 6,460,006 | B1 | 10/2002 | Corcoran | |
| 6,973,821 | B2 * | 12/2005 | Corcoran | 73/78 |
| 7,302,837 | B2 | 12/2007 | Wendte | |
| 7,428,455 | B2 | 9/2008 | Corcoran | |
| 7,581,452 | B2 | 9/2009 | Sandomirsky et al. | |
| 7,623,951 | B2 | 11/2009 | Congdon et al. | |
| 7,682,102 | B1 * | 3/2010 | Burke et al. | 404/133.1 |
| 7,731,450 | B2 | 6/2010 | Congdon et al. | |
| 7,873,492 | B2 * | 1/2011 | Ackermann | 702/150 |
| 2007/0239338 | A1 | 10/2007 | Potts et al. | |
| 2008/0260462 | A1 * | 10/2008 | Ackermann | 404/124 |
| 2012/0107045 | A1 | 5/2012 | DeClerk et al. | |
| 2012/0144704 | A1 | 6/2012 | Cone et al. | |
| 2013/0004237 | A1 * | 1/2013 | Krings et al. | 404/75 |
| 2013/0045072 | A1 | 2/2013 | Jensen | |
| 2013/0071214 | A1 | 3/2013 | Itou et al. | |

FOREIGN PATENT DOCUMENTS

| | | | |
|---|---|---|---|
| EP | 2341189 | A2 | 7/2011 |
| JP | 2011-063967 | A | 3/2011 |

* cited by examiner

*Primary Examiner* — Abigail A Risic
(74) *Attorney, Agent, or Firm* — Leydig, Voit & Mayer, Ltd.

(57) ABSTRACT

A system for determining a state of compaction of a work material includes a compactor and a compaction sensor system. A controller is configured to determine an empirical state of compaction of the work material based upon signals from the compaction sensor system and the characteristics of a machine associated with the compaction sensor system.

18 Claims, 4 Drawing Sheets

SYSTEM AND METHOD FOR DETERMINING A STATE OF COMPACTION

TECHNICAL FIELD

This disclosure relates generally to machines that compact material, and more particularly, to a system and method for determining an empirical state of compaction of a work material at a work site.

BACKGROUND

Compacting machines or compactors are commonly used to compact work materials (such as soil, gravel, asphalt, landfill trash) to a desired density while constructing buildings, highways, parking lots, and other structures. In addition, compactors are often used to compact recently moved and/or relatively soft materials at mining sites and landfills. The process often requires a plurality of passes over the work material to reach the desired density.

Determining whether the desired level of compaction has been reached is often estimated in a variety of manners. In some instances, the compaction may be approximated by determining the ability of the work material to support a machine. For example, the penetration depth of toothed wheels of a compactor may be monitored as the teeth will penetrate less as the work material becomes more compacted. Other systems are also used to determine the ability of the work material to support a machine.

These systems typically determine the relative state of compaction of the work material. In other words, the systems determine the extent to which the work material has been compacted relative to the maximum compaction capacity or capability of the machine. As a result, the systems may determine that a work material has been compacted to some percentage of the maximum compacting capability of the machine. However, such systems do not provide an absolute or empirical measure of the state of compaction.

As a result, operators must perform secondary tests or evaluations at the work site to determine the actual state of compaction of the work material. Some of the secondary tests require the removal of material from an otherwise finished work surface. In addition, it may be necessary to perform tests at multiple locations to determine whether the desired level of compaction has been uniformly achieved.

U.S. Pat. No. 7,581,452 discloses a system in which distance measuring devices or sensors may be mounted to a vehicle and used to determine the distance between the sensors and the soil surface upon which the vehicle is operating. The distance from the sensors to the surface may be measured at locations at which the vehicle has traveled as well as locations at which the vehicle has not traveled. The measurements may be compared to determine the depth of a track made by the tire or wheel of a vehicle as the vehicle traveled along on the soil. The depth of the track may be used to calculate strength of the soil.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In a one aspect, a system for determining a state of compaction of a work material during a compaction operation includes a compactor associated with a machine and configured to engage and compact the work material, a compaction sensor system associated with the machine for generating signals indicative of the state of compaction of the work material, and a controller. The controller is configured to store characteristics of the machine, receive signals from the compaction sensor system indicative of the state of compaction of the work material, and determine an empirical state of compaction of the work material based upon signals from the compaction sensor system and the characteristics of the machine.

In another aspect, a controller-implemented method for determining a state of compaction of a work material during a compaction operation includes storing characteristics of a machine, receiving signals from a compaction sensor system associated with the machine indicative of the state of compaction of the work material as a compactor associated with the machine engages and compacts the work material, and determining an empirical state of compaction of the work material based upon signals from the compaction sensor system and the characteristics of the machine.

In still another aspect, a machine includes a prime mover, a position sensing system associated with the machine for determining a position of the machine, a compactor associated with a machine and configured to engage and compact the work material, a compaction sensor system associated with the machine for generating signals indicative of the state of compaction of the work material, and a controller. The controller is configured to store characteristics of the machine, receive signals from the compaction sensor system indicative of the state of compaction of the work material, and determine an empirical state of compaction of the work material based upon signals from the compaction sensor system and the characteristics of the machine.

DETAILED DESCRIPTION

Figure 1:
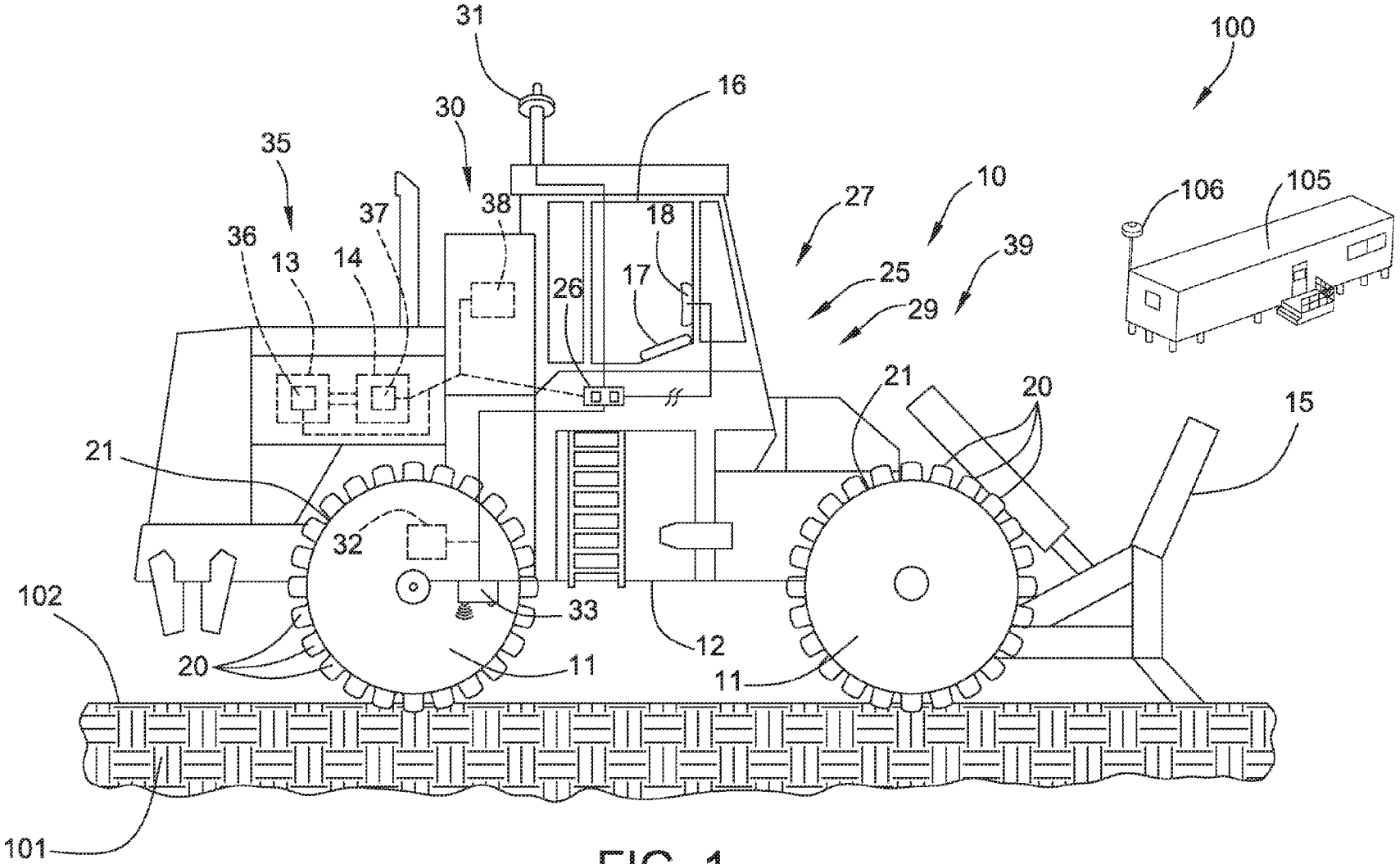
FIG. 1 illustrates a diagrammatic view of a machine in accordance with the disclosure.

FIG. 1 depicts a diagrammatic illustration of a machine 10 such as a self-propelled compactor with a pair of rotatably mounted, spaced apart rollers 11 for compacting a work material 101 at work site 100. The machine 10 includes a frame 12 and a prime mover such as an engine 13. In one embodiment, machine 10 may be configured with a type of mechanical drive system so that engine 13 drives a torque converter 14 which in turn drives a transmission (not shown). The transmission may be operatively connected to the rollers 11. The systems and methods of the disclosure may be used with any machine propulsion and drivetrain mechanisms applicable in the art including hydrostatic, electric, or mechanical drives.

A ground-engaging work implement such as blade 15 may be provided. Machine 10 may include a cab 16 that an operator may physically occupy and provide input to control the machine. Cab 16 may include one or more input devices 17 through which the operator may issue commands to control propulsion and steering systems of the machine 10 as well as operate other systems and implements associated with the machine. A display 18 may be provided in cab 16 on which information useful or necessary for the operation of the machine 10 may be displayed.

As depicted, rollers 11 include a plurality of teeth or projecting tips 20 projecting radially from a cylindrical outer drum surface 21. Projecting tips 20 may be any of a wide variety of drum trip configurations, including sheep's foot, pad foot, or other tip designs. Although machine 10 is depicted as a self-propelled compactor, the system disclosed herein may be used with any compactor system including a tow-behind drum compactor, a single drum compactor having rearwardly mounted ground engaging propulsion wheels (FIG. 4), or still another type of compactor. Still further, in some instances, the system may further be used with smooth rollers (i.e., those that do not include projecting tips 20).

Figure 3:
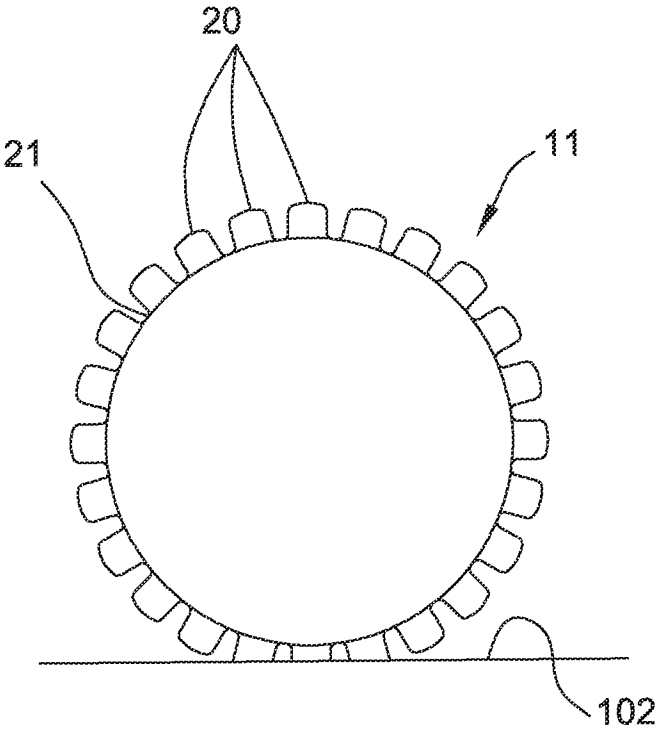
FIG. 3 illustrates a diagrammatic view similar to FIG. 2 but with the roller engaging a relatively hard work surface.
Figure 2:
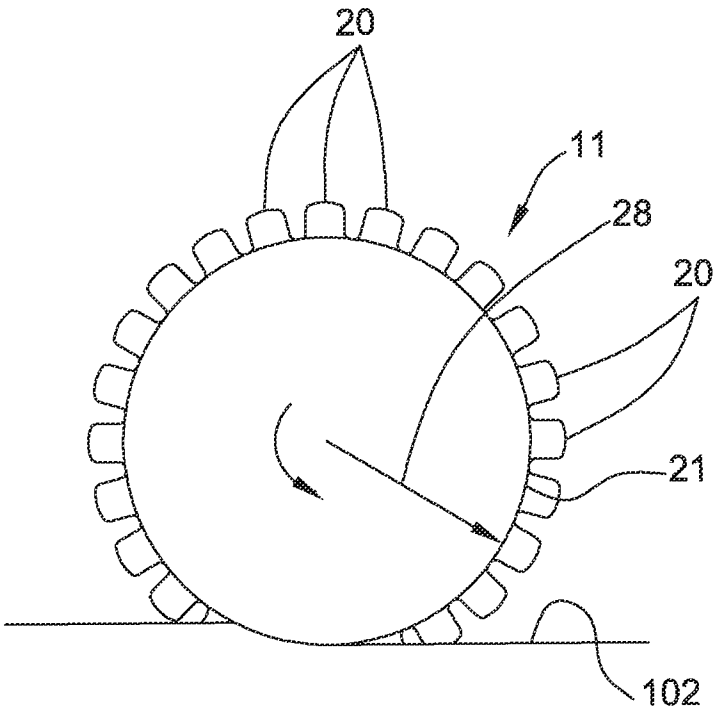
FIG. 2 illustrates a diagrammatic view of a roller of the machine of FIG. 1 engaging a relatively soft work surface.

Machine 10 generally operates on the work surface 102 of the work material 101. Work material 101 may include any material such as soil, sand, gravel, asphalt, landfill trash, and another types of material. As machine 10 moves over the work surface, the rollers 11 compact the work material at and below the work surface. As depicted in FIG. 2, as machine 10 moves over a portion of the work surface 102 that is relatively soft, the projecting tips 20 of rollers 11 may penetrate through the work surface 102 and into the work material 101. In such case, the cylindrical outer drum surface 21 of roller 11 may engage the work surface 102. As the work material 101 adjacent work surface 102 is compacted, the work material may eventually be able to support the machine 10 with less penetration of the projecting tips 20 of the rollers 11 into the work material as depicted in FIG. 3.

As the level of compaction of the work material 101 increases so that the penetration of the projecting tips 20 into the work material is reduced, the cylindrical outer drum surface 21 of the rollers 11 will no longer engage the work surface 102. This is often referred to as "walk out." "Walk out" occurs as weight bearing capacity of the work material 101 increases which decreases the sinkage or penetration of the projecting tips 20 of the roller 11 into the work surface 102.

Machine 10 may include a control system 25 as shown generally by an arrow in FIG. 1 indicating association with the machine 10. The control system 25 may utilize various input devices to control the machine 10 and one or more sensors to provide data and input signals representative of various operating parameters of the machine 10 and the environment of the work site at which the machine is operating. The control system 25 may include an electronic control module or controller 26 and a plurality of sensors associated with the machine 10.

The controller 26 may be an electronic controller that operates in a logical fashion to perform operations, execute control algorithms, store and retrieve data and other desired operations. The controller 26 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 26 such as power supply circuitry, signal conditioning circuitry, driver circuitry, and other types of circuitry.

The controller 26 may be a single controller or may include more than one controller disposed to control various functions and/or features of the machine 10. The term "controller" is meant to be used in its broadest sense to include one or more controllers and/or microprocessors that may be associated with the machine 10 and that may cooperate in controlling various functions and operations of the machine. The functionality of the controller 26 may be implemented in hardware and/or software without regard to the functionality. The controller 26 may rely on one or more data maps relating to the operating conditions and the operating environment of the machine 10 and the work site 100 that may be stored in the memory of controller. Each of these data maps may include a collection of data in the form of tables, graphs, and/or equations.

The control system 25 may be located on the machine 10 and may also include components located remotely from the machine such as at a command center 105. The functionality of control system 25 may be distributed so that certain functions are performed at machine 10 and other functions are performed remotely. In such case, the control system 25 may include a communications system such as wireless network system 106 for transmitting signals between the machine 10 and a system located remote from the machine.

Control system 25 may include one or more sensors that provide data that the control system uses to determine the state or extent of compaction of the work material 101. The term "sensor" is meant to be used in its broadest sense to include one or more sensors and related components that may be associated with the machine 10 and that may cooperate to sense various functions, operations, and operating characteristics of the machine. A compaction sensor system 27 is shown generally by an arrow in FIG. 1 indicating association with the machine 10.

In a first embodiment, the compaction sensor system 27 may include an effective radius sensor indicated generally at 29 to sense, directly or indirectly, the effective radius of the rollers 11 of the machine 10 to determine the extent of compaction of the work material 101. The effective radius is defined as the machine travel distance per wheel revolution divided by $2\pi$. Referring to FIG. 2 as an example, when the machine 10 begins a compacting operation, the work material 101 may be relatively soft and the tips 20 of the rollers 11 may penetrate the work surface 102. As a result, the effective radius of the rollers 11 may be substantially less than the actual radius 28 of the cylindrical outer drum surface 21 of roller 11. As the work material 101 becomes harder with each pass of the machine, the effective radius will increase as the roller 11 experiences "walk out" and the tips 20 of the roller 11 penetrate the work material 101 less as depicted in FIG. 3. The state or extent of compaction of the work material 101 may be determined by monitoring the difference between the actual radius and the effective radius.

The effective radius sensor generates an effective radius signal indicative of an effective radius of the roller 11 and the controller 26 is configured to determine the effective radius of the roller based upon the effective radius signal. In one example, the effective radius sensor 29 may include sensors that directly or indirectly measure the distance traveled by the machine 10 over a specified period of time. For example, a position sensing system 30, as shown generally by an arrow in FIG. 1 indicating association with the machine 10, may include a position sensor 31 operative to sense a position of the machine relative to the work surface 102. The position sensor 31 may include one or more sensors that interact with a positioning system such as a global navigation satellite system or a global positioning system to operate as a position sensor. The position sensor 31 may be used to determine the position of the machine 10 and the distance that the machine travels over a specified period of time may be used to determine a ground speed of machine 10.

The effective radius sensor 29 may further include angular sensors 32 that provide signals indicative of the angular position and/or angular rotation rate of the rollers 11. The effective radius may be determined by determining the ratio of the distance traveled along the work surface 102 (based upon the position sensing system 30) to the number of rotations undergone by the roller 11 to traverse that distance. Other manners of determining the distance traveled by the machine 10 as well as other manners of determining the effective radius are contemplated.

In a second embodiment, the compaction sensor system 27 may include a machine height sensor to sense, directly or indirectly, the height of the machine 10 relative to the work surface 102. Machine height sensor 33 may be configured to sense a parameter indicative of the height of the frame 12 above the work surface 102 and generate a machine height signal indicative of the height of the machine. The controller 26 may be configured to determine the machine height based upon the machine height signal. Machine height sensor 33 may include a signal transducer (not shown) configured to sense a transmitted signal, or component of a transmitted signal, reflected by work surface 102. The transmitted signal may include, for example, a sonic signal, an RF signal, or a laser signal transmitted via a transmitter. Machine height sensor 33 may include a non-contact sensor such as the examples noted above. In other embodiments, a gauge wheel, skid or the like might be coupled with frame 12, and configured to change vertical position responsive to changes in axle height above work surface 102. In still other embodiments, the height of the machine 10 relative to the work surface 102 may be determined by the position sensing system 30 based upon information received from the position sensor 31.

As the machine 10 begins a compacting operation, the work material 101 may be relatively soft and the tips 20 of the rollers 11 may penetrate the work surface 102. As a result, the height of the machine 10 relative to the work surface 102 is at a relative minimum when in an uncompacted stated as depicted in FIG. 2. As the work material 101 becomes more compacted with each pass of the machine 10, the roller 11 experiences "walk out" and the tips 20 of the roller 11 penetrate the work material 101 less as depicted in FIG. 3. Accordingly, the height of the machine relative to the work surface 102 will increase as the work material 101 becomes more compacted.

In a third embodiment, the compaction sensor system 27 may includes a rolling resistance sensor 35 configured to sense a relative rolling resistance of the machine 10 as it moves across the work surface 102. As the machine 10 moves across the work surface 102, the energy necessary to propel the machine 10 is generally inversely proportional to the load bearing capacity of the work material 101. In other words, the softer the work material 101, the higher the rolling resistance and the more energy required to propel the machine 10. As the work material 101 becomes more compacted, it generally becomes relatively stiffer and less energy is required to move the machine 10 along the work surface 102.

In one example, the rolling resistance may include determining the difference between the input to and the output from the torque converter 14. For greater accuracy, the calculation may further take into consideration the inclination of the work surface 102 at the particular region of interest. In doing so, an engine speed sensor 36 may be operatively associated with engine 13 and utilized to generate a signal indicative of the speed or output of the engine 13. A torque converter speed sensor 37 may be operatively associated with torque converter 14 and utilized to monitor the output speed of the torque converter 14. An inclinometer 38 may be provided to determine the slope of the work surface 102 in the region at which the machine 10 is operating. Alternatively, other slope measuring devices including using data from the position sensing system 30 may be used.

During operation of the machine 10, a difference between the output speed of the engine 13 and the output speed of the torque converter 14 may be used to determine the difference between the input to and the output from the torque converter 14. The control system 25 may use the sensed inclination of the work surface 102 to equate the energy necessary to propel the machine 10 to a common inclination or otherwise adjust the calculation to reflect the incline of the work surface.

Other sensors and systems for sensing the rolling resistance of the work surface 102 and generating a rolling resistance signal are contemplated. For example, if the machine 10 includes a hydrostatic drive, the rolling resistance may be calculated based on sensed hydraulic pressure and flow rate to give an indication of the amount of machine energy imparted to the work material 101.

Figure 4:
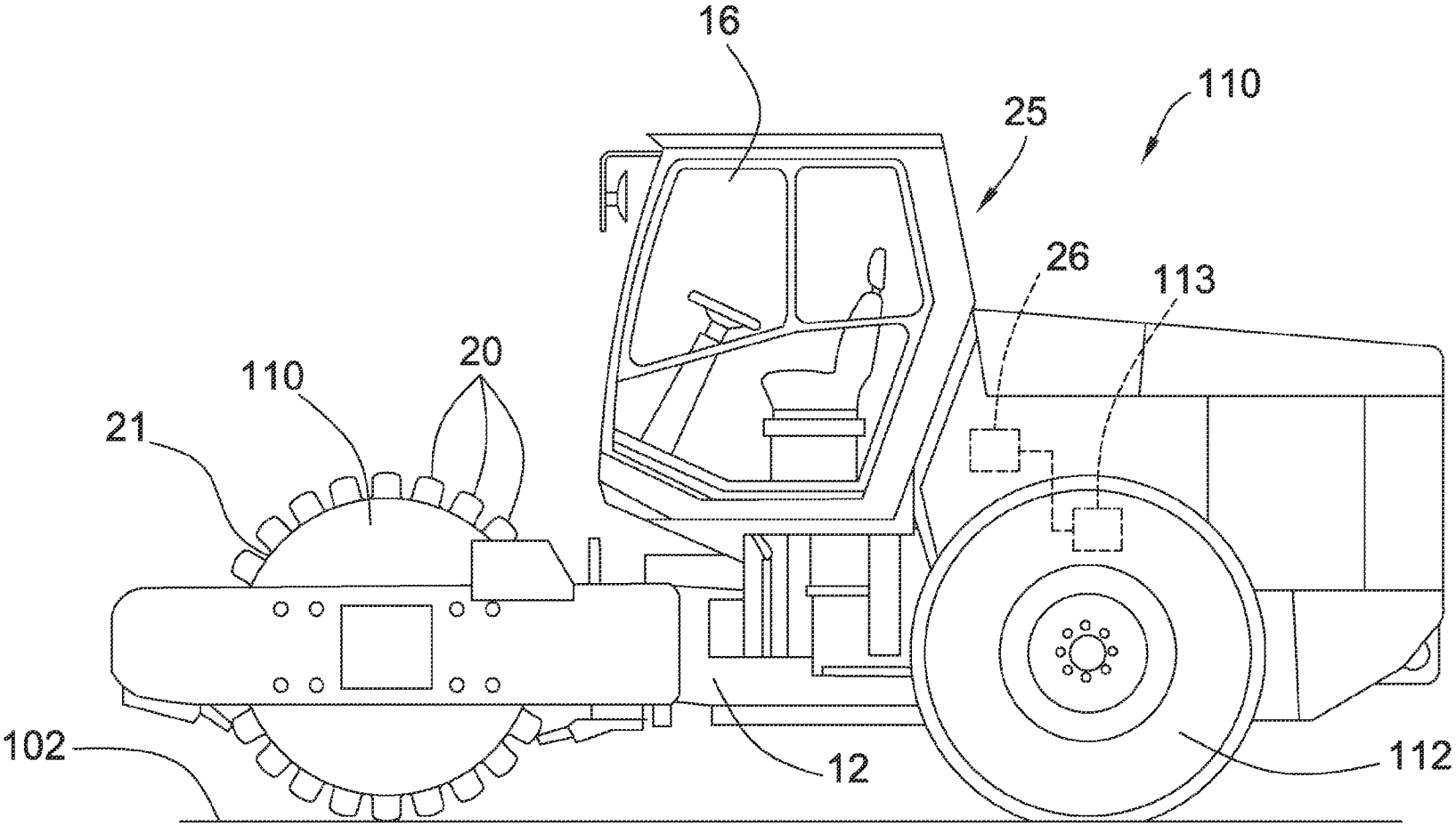
FIG. 4 illustrates a diagrammatic view of an alternate embodiment of a machine in accordance with the disclosure.

Referring to FIG. 4, a machine 110 such as single drum compactor is depicted having a single roller or drum 111 and one or more deflectable tires 112 such as those made of rubber or the like. In such case, the compaction sensor system 27 may includes a tire deflection sensor 113 such as a transducer associated with one or more of the deflectable tires 112 to measure the deflection of the tires. In one example, the tire deflection sensor 113 may be positioned internally of the deflectable tire 112 and may generate tire deflection signals indicative of the deflection of the tire. The controller 26 may be configured to determine the deflection of the deflectable tire 112 based upon the tire deflection signal.

As described above with respect to FIGS. 2-3, as the machine 110 begins a compacting operation, the work material 101 may be relatively soft. In general, the softer the work material 101, the less the deflectable tires 112 will deflect. As a result, when operating on relatively uncompacted material, the deflectable tires 112 may penetrate the work surface 102 to some extent and thus their deflection may be relatively small. As the compacting operation continues and the work material 101 becomes harder and deflects less, the deflection of the deflectable tires 112 will increase. By monitoring the signals provided by the tire deflection sensor 113, the increase in deflection of the deflectable tires 112 may be measured and the relative increase in the state of compaction of the work material 101 determined.

Still other systems for measuring the extent or state of compaction of the work material 101 and their associated compaction sensor systems 27 are contemplated. For example, some systems may utilize vibratory signals that are monitored to sense changes in the density of the work material 101. In another example, changes in the depth of a track or rut made by tires of a machine may be monitored to determine the level of compaction of the work material 101.

The compaction sensor systems 27 provide a relative level of compaction of the work material 101. More specifically, the compaction sensor systems 27 provide an output that is reflective of the state of compaction of the work material 101. As the machine 10 performs compacting operations, the compaction sensor systems 27 provide output that reflects the increase in the state of compaction. However, the change in the signals from the compaction sensor systems 27 reflects a relative change in the compaction of the work material 101 but does not provide an absolute or empirical value of the state of compaction. In some compactions systems, the state of compaction is indicated relative to the compaction capability of the machine 10. As a result, the output may sometimes be in the form of a relative numerical value (e.g., a scale of 1 to 100) or a display in which lights indicate the relative state of compaction.

It should be noted that each machine has a maximum compaction capability. The maximum compaction capability may be a function of a variety of factors such as the weight of the machine 10 and the size of the bearing surface of the machine. The size of the bearing surface may be a function of the dimensions of the rollers 11 such as their width and radius. Still further, the shape and length of any tips 20 on the roller 11 as well as the use of a vibratory system to assist in compaction may also affect the compaction capability of machine 10. As a result, the actual level of compaction of work material 101 may be identical even if systems on two different machines reflect different levels of relative compaction.

In order to provide a more useful and consistent reflection of the compaction of the work material 101, the control system 25 may include a compaction state system 39 that quantifies the state of compaction of the work material 101 regardless of the type and characteristics of the machine 10. More specifically, the compaction state system 39 may determine the absolute or empirical state of compaction of the work material 101 and provide an output in terms of generally recognized standard engineering units. For example, the compaction state system 39 may use the state of compaction of the work material 101 to determine or calculate the material's ability to support a load applied to the work surface 102 (i.e., the bearing strength of the material). In another example, the compaction state system 39 may use the state of compaction to determine the permeability of the work material. In such case, it may be desirable or necessary to identify characteristics of the work material 101 such as the type of material and its moisture content. The compaction state system 39 may include data maps stored in controller 26 that are used for such determinations.

Figure 5:
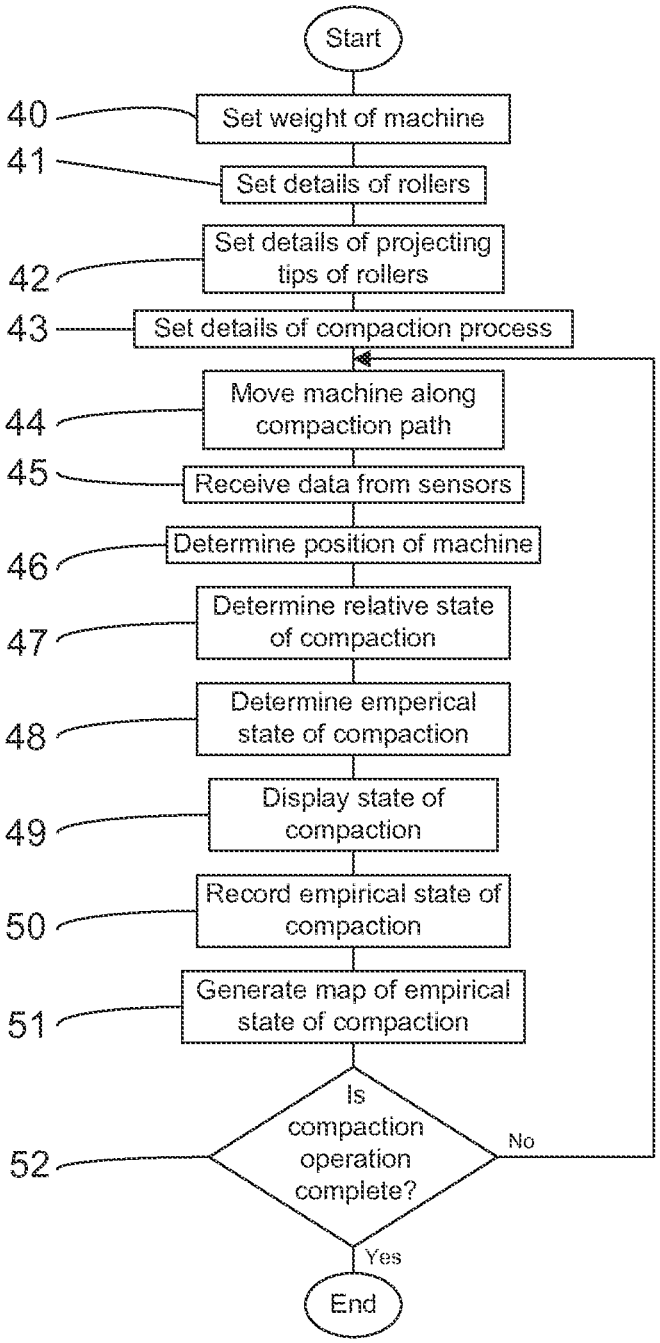
FIG. 5 illustrates a flowchart of a process for determining the state of compaction of a work surface during a compaction operation.

Operation of the compaction state system 39 is depicted in the flowchart in FIG. 5. Initially, the characteristics of the machine 10 may be stored. For example, at stage 40, the weight of the machine 10 may be set within controller 26. The weight may be set in a variety of manners such as by entering the known weight of the machine 10, by entering the model of the machine, or by entering a code associated with the machine either electronically (such as with a barcode, an RFID, or the like) or manually. The details of the rollers 11 may be set within controller 26 at stage 41. For example, the length and radius or diameter of the rollers 11 may be entered into controller 26. In addition, at stage 42, the existence and characteristics (length, shape, and pattern on roller 11) of any tips 20 radially projecting from the cylindrical outer drum surface 21 of roller 11 may be set within controller 26. The characteristics of the compaction process may be set within controller 26 at stage 43. These characteristics may include the details of any vibratory system that will be used to assist in the compaction process. If the compaction state system 39 is being used to determine the permeability of the work material 101, the characteristics of the work material may also be entered at this time. Each of the values identified at stages 40-43 may be set as defaults within controller 26 or entered by an operator, management personnel, or other personnel either at machine 10 or at a location remote from the machine.

The compaction process may begin at stage 44 by moving the machine 10 along a compaction path. As the machine 10 moves along the compaction path, the controller 26 may receive at stage 45 signals or data from various sensors including the compaction sensor system 27 and the position sensor 31. At stage 46, the controller 26 may determine the position of machine 10 based upon the position sensor 31 and the position sensing system 30.

The controller 26 may utilize signals from the compaction sensor system 27 to determine at stage 47 the relative state of compaction of the work material 101. As described above, the relative state of compaction may be determined in a variety of manners and thus the compaction sensor system 27 may take many different forms. In each case, the compaction sensor system 27 provides a signal indicative, directly or indirectly, of the compaction of the work material 101. For example, the effective radius sensor 29 generates signals that may be used to monitor the effective radius of the roller 11 or wheels of the machine as they move along work surface 102. Similarly, the machine height sensor 33 generates signals that may be used to monitor the height of the machine 10 above the work surface 102. The rolling resistance sensor 35 may be used to monitor the rolling resistance of the machine 10 as it moves along the work surface 102 and the tire deflection sensor 113 may be used to monitor the amount of deflection in a deflectable tire 112 as the machine moves along the work surface. In each case, the amount or state of compaction of the work material 101 may be reflected as a value relative to a maximum level of compaction of which the machine 10 is capable of providing.

It is often desirable to provide or report the state of compaction of the work material 101 in terms of engineering concepts and/or industry and regulatory reporting requirements. Accordingly, the compaction state system 39 may determine at stage 48 an absolute or empirical state of compaction of the work surface 102 (such as the bearing strength) based upon the relative state of compaction and the characteristics of the machine 10 and the characteristics of the compaction process. The controller 26 may have stored therein data maps for such a determination. The data maps may be created or determined based upon testing of different machines having differently configured rollers (included smooth and those with radially projecting tips 20) while operating with different characteristics of the compaction process on different types of materials and at different levels or states of compaction.

In one example, tests such as a plate load test and/or a falling weight deflectometer test may be conducted on the work surface 102 to determine the actual bearing strength of the work material 101. A machine 10 may be operated at the test location and readings from different types of compaction sensor systems 27 may be correlated for the actual bearing strength of the work material 101. By repeating the process at different levels of compaction for a plurality of different types of machines with different sizes and configurations of rollers and with the different characteristics of the compaction process, desired data maps may be generated that are indicative of the bearing strength or capacity of the work material 101. If desired, the data maps may be set to indicate or generate results in terms of other desired engineering concepts and/or industry and regulatory reporting requirements such as permeability.

It should be noted that in some instances, the controller 26 may not determine the relative state of compaction at stage 47 but may determine directly the empirical state of compaction at stage 48 based upon the data from the compaction sensor systems 27 and the characteristics of the machine 10 and the characteristics of the compaction process.

At stage 49, the state of compaction data may be displayed on a display 18 within the cab 16. In one example, the state of compaction data may be displayed in terms of the relative state of compaction by using indicator lights such as red, yellow, and green, by displaying numbers on a scale such as 1 to 100, a combination of the two such as color-coded bar graph, or any other desired display. In another example, the empirical state of compaction may be displayed in terms of engineering concepts such as bearing strength or permeability.

The empirical state of compaction data may be recorded within controller 26 at stage 50 at machine 10 and/or at a remote location. The empirical state of compaction data may also be stored with the position data from the position sensing system 30 to create an electronic map of the state of compaction at the work site 100 at which the machine 10 is operating. The electronic map may be stored within controller 26 at machine 10. In addition, the electronic map may be communicated to a system at a location remote from the machine 10 and/or shared with other machines through a peer-to-peer communications system. Such electronic map may be used to identify areas that require additional compaction and may also be used to maintain historical data of the state of compaction of the work material 101 throughout the work site 100.

At decision stage 52, if the compaction operation is not complete, movement of the machine 10 is continued at stage 44 and the process of stages 44-52 repeated.

INDUSTRIAL APPLICABILITY

The industrial applicability of the system described herein will be readily appreciated from the forgoing discussion. The foregoing discussion is applicable to machines 10 such as compactors that engage the work surface 102 above a work material 101 to compact the material to prepare it for a subsequent use or otherwise reduce its volume. Such system may be used at a mining site, a landfill, a construction site, a roadwork site, or any other area in which compaction of work material 101 is desired. It should be note that the system described herein may also be used with machines whose primary purpose is not compacting work material 101. For example, other machines such those used to haul material including earthmoving scrapers, haul trucks, and other mobile machines may include the system described herein.

When compacting a work material 101, it may be desirable to not only determine the relative state of compaction of the work material but also the absolute or empirical state of compaction in terms of engineering concepts and/or industry and regulatory reporting requirements. The compaction state system 39 is operative to utilize data from compaction sensor systems 27 as well as the characteristics of the machine 10 to determine the absolute or empirical state of compaction of the work material. The characteristics of the machine 10 may include its weight and the bearing surface of the rollers 11 or other wheels. The compaction state system 39 may also use the existence and characteristics (length, shape, and pattern on roller 11) of any tips 20 radially projecting from the cylindrical outer drum surface 21 of roller 11. An electronic map of the work site 100 including the state of compaction expressed in terms of generally recognized standard engineering units may be generated and stored within controller 26 and/or at a remote location It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for determining a state of compaction of a work material during a compaction operation, comprising:

a compactor associated with a machine and configured to engage and compact the work material;

a compaction sensor system associated with the machine for generating signals indicative of the state of compaction of the work material; and a controller configured to:

store a plurality of data maps that define an absolute state of compaction based upon the characteristics of the machine, different types of materials, and different states of compaction;

store characteristics of the machine;

receive signals from the compaction sensor system indicative of the state of compaction of the work material; and determine the absolute state of compaction of the work material based upon signals from the compaction sensor system, the characteristics of the machine, and at least one of the plurality of data maps.

2. The system of claim 1, wherein the controller is further configured to determine a relative state of compaction of the work material based upon the signals from the compaction sensor system and determine the absolute state of compaction of the work material based upon the relative state of compaction of the work material and the characteristics of the machine.

3. The system of claim 1, wherein the controller is further configured to display the absolute state of compaction of the work material in terms of an established engineering reference on a display.

4. The system of claim 3, wherein the controller is further configured to display the absolute state of compaction of the work material in terms of one of a bearing strength or permeability of the work material.

5. The system of claim 1, wherein the controller is further configured to store the absolute state of compaction.

6. The system of claim 1, further including a position sensing system associated with the machine for determining a position of the machine and the controller is configured to determine the position of the machine based upon the position sensing system and generate an electronic map of the absolute state of compaction of the work material at a work site as the machine moves about the work site.

7. The system of claim 1, wherein the characteristics of the machine include a weight of the machine and a size of a bearing surface of the machine.

8. The system of claim 1, wherein the compactor includes a roller.

9. The system of claim 8, wherein the roller includes a plurality of radially projecting tips.

10. The system of claim 1, wherein the controller is configured to determine the absolute state of compaction in terms of one of a bearing strength or permeability of the work material.

11. A controller-implemented method for determining a state of compaction of a work material during a compaction operation, comprising:

storing a plurality of data maps that define the absolute state of compaction based upon the characteristics of the machine, different types of materials, and different states of compaction;

storing characteristics of a machine;

receiving signals from a compaction sensor system associated with the machine indicative of the state of compaction of the work material as a compactor associated with the machine engages and compacts the work material; and determining the absolute state of compaction of the work material based upon signals from the compaction sensor system, the characteristics of the machine, and at least one of the data maps.

12. The method of claim 11, further including determining a relative state of compaction of the work material based upon the signals from the compaction sensor system and determining the absolute state of compaction of the work material based upon the relative state of compaction of the work material and the characteristics of the machine.

13. The method of claim 11, further including moving the machine about a work site, determining a position of the machine based upon a position sensing system associated with the machine and generating an electronic map of the absolute state of compaction of the work material at a work site as the machine moves about the work site.

14. The method of claim 11, further including displaying on a display the absolute state of compaction of the work material in terms of an established engineering reference.

15. The method of claim 14, further including displaying the absolute state of compaction of the work material in terms of one of a bearing strength or permeability of the work material.

16. The method of claim 11, further including storing the absolute state of compaction.

17. The method of claim 11, further including determining the absolute state of compaction in terms of one of a bearing strength or permeability of the work material.

18. A machine comprising:

a prime mover;

a position sensing system associated with the machine for determining a position of the machine;

a compactor associated with a machine and configured to engage and compact the work material;

a compaction sensor system associated with the machine for generating signals indicative of the state of compaction of the work material; and a controller configured to:

store a plurality of data maps that define an absolute state of compaction based upon the characteristics of the machine, different types of materials, and different states of compaction;

store characteristics of the machine;

receive signals from the compaction sensor system indicative of the state of compaction of the work material; and determine the absolute state of compaction of the work material based upon signals from the compaction sensor system, the characteristics of the machine, and at least one of the data maps.

* * * * *